US005878302A

United States Patent [19]

Inui et al.

[11] Patent Number: 5,878,302

[45] Date of Patent: Mar. 2, 1999

[54] IMAGE FORMING APPARATUS INFORMING INTERNAL ABNORMALITY

[75] Inventors: Kazuo Inui, Toyohashi; Hiroshi Yamada, Toyokawa; Junko Natsume, Aichi, all of Japan

[73] Assignee: Minolta Co., Ltd., Osaka, Japan

[21] Appl. No.: 947,337

[22] Filed: Oct. 8, 1997

[30] Foreign Application Priority Data

Mar. 12, 1997 [JP] Japan ..... 9-057439

[51] Int. Cl.[6] ..... G03G 15/00

[52] U.S. Cl. ..... 399/81; 399/361; 345/40

[58] Field of Search ..... 399/81, 21, 361; 345/4, 5, 33, 40

[56] References Cited

U.S. PATENT DOCUMENTS 5,696,597 12/1997 Miura ..... 399/81 X 5,754,924 5/1998 Yamada ..... 399/81

FOREIGN PATENT DOCUMENTS 62-210481 6/1987 Japan .

4-119364 4/1992 Japan .

*Primary Examiner*—Richard Moses

*Attorney, Agent, or Firm*—McDermott, Will & Emery

[57] ABSTRACT

A copying machine according to the present invention having a multi-job function can perform processing to a current job and a sub job, and errors are divided into two stages. If a high level error occurs in a job processed as the sub job, the job is switched to the current job, and the error is widely displayed on the entire display portion. If a low level error occurs in a job processed as the sub job, the error is displayed in a small sub job display portion in the display. As a result, the user can be accurately informed of an error occurring in the sub job in the copying machine.

18 Claims, 12 Drawing Sheets

IMAGE FORMING APPARATUS INFORMING INTERNAL ABNORMALITY

BACKGROUND OF THE INVENTION

1. Field of the Invention

The present invention relates generally to image processing apparatus capable of simultaneously executing a plurality of jobs in parallel. The invention also relates to an image forming apparatus capable of simultaneously executing in parallel a operation of reading images of a first group of originals and an operation of printing images of a second group of originals.

2. Description of the Related Art

There have been image forming apparatuses such as copying machine and printer having a multi-job function capable of reading image data from a group of originals and printing images of another group of originals independently from each other. Such an image forming apparatus is provided with a display device for displaying the internal state of the apparatus or the set image forming condition. The image forming apparatus having the multi-job function can simultaneously perform a plurality of operations, the display of these operations can be complicated as compared to an image forming apparatus without such a multi-job function.

The display for use in such an image forming apparatus is disclosed by Japanese Patent Laying-Open Nos. 62-210481 and 4-119364.

According to Japanese Patent Laying-Open No. 62-210481, the copying machine permits input of an operation condition for a job during recording another job, and has two display portions, a first display portion for displaying the operation condition of the job being recorded and a second display portion for displaying the operation condition of the job being input.

According to Japanese Patent Laying-Open No. 4-119364, the copying machine alternately displays the operation conditions of first and second jobs on a single display portion.

In the former apparatus, since information is always displayed in a fixed display area, the operator tends to overlook a change in the state of display. In the latter apparatus, the operator cannot confirm one operation condition while the other operation condition is displayed.

SUMMARY OF THE INVENTION

It is therefore one object of the invention to provide an image forming apparatus capable of accurately displaying the operation state of the apparatus to the operator.

Another object of the invention is, in an image forming apparatus capable of executing a plurality of jobs in parallel, to accurately display the operation state of each job to the operator.

Yet another object of the invention is, in an image forming apparatus, to accurately display the operation state of the apparatus to the operator, by changing the display state depending upon the level of importance of the operation state.

These objects of the invention are accomplished by providing the following elements in the image forming apparatus.

More specifically, according to the present invention, a processor executing a prescribed operation includes a display for displaying information related to the state of the operation being executed, a determination control unit for determining the operation state and the level of its importance, and a controller permitting a display area on the display to be set depending upon the result of determination by the determination control unit and the determined operation state to be displayed in the set display area.

The state of operation being executed is determined, the operation state is displayed depending upon the result of determination of the level of its importance, and therefore an image forming apparatus capable of accurately displaying the operation state of the apparatus to the operator is provided.

According to another aspect of the invention, an image forming apparatus capable of simultaneously executing in parallel a plurality of jobs to images includes a display for simultaneously displaying information related to the plurality of jobs executed in parallel. The display has a first, large display area and a second, small display area, and displays information related to a job in one display area and information related to another job in the other display area. The image forming apparatus further includes a controller for switching between information displayed in the first display area and information displayed in the second display area. The controller determines the state of each job and makes such a control to display information related to a job having high level importance in the first display area and information related to a job having low level importance in the second display area.

Since the states of a plurality of jobs are determined, information related to a job with high level importance is displayed in the larger display area and information related to a job with low level importance is displayed in the smaller display area. Therefore, the operation state of each job can be accurately displayed to the operator in the image forming apparatus capable of executing a plurality of jobs in parallel.

In addition, the display state changes depending upon the importance of the operation state, the operation state of the apparatus can be accurately displayed to the operator.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, a copying machine having a multi-job function according to one embodiment of the invention will be described in conjunction with the accompanying drawings.

Figure 1:
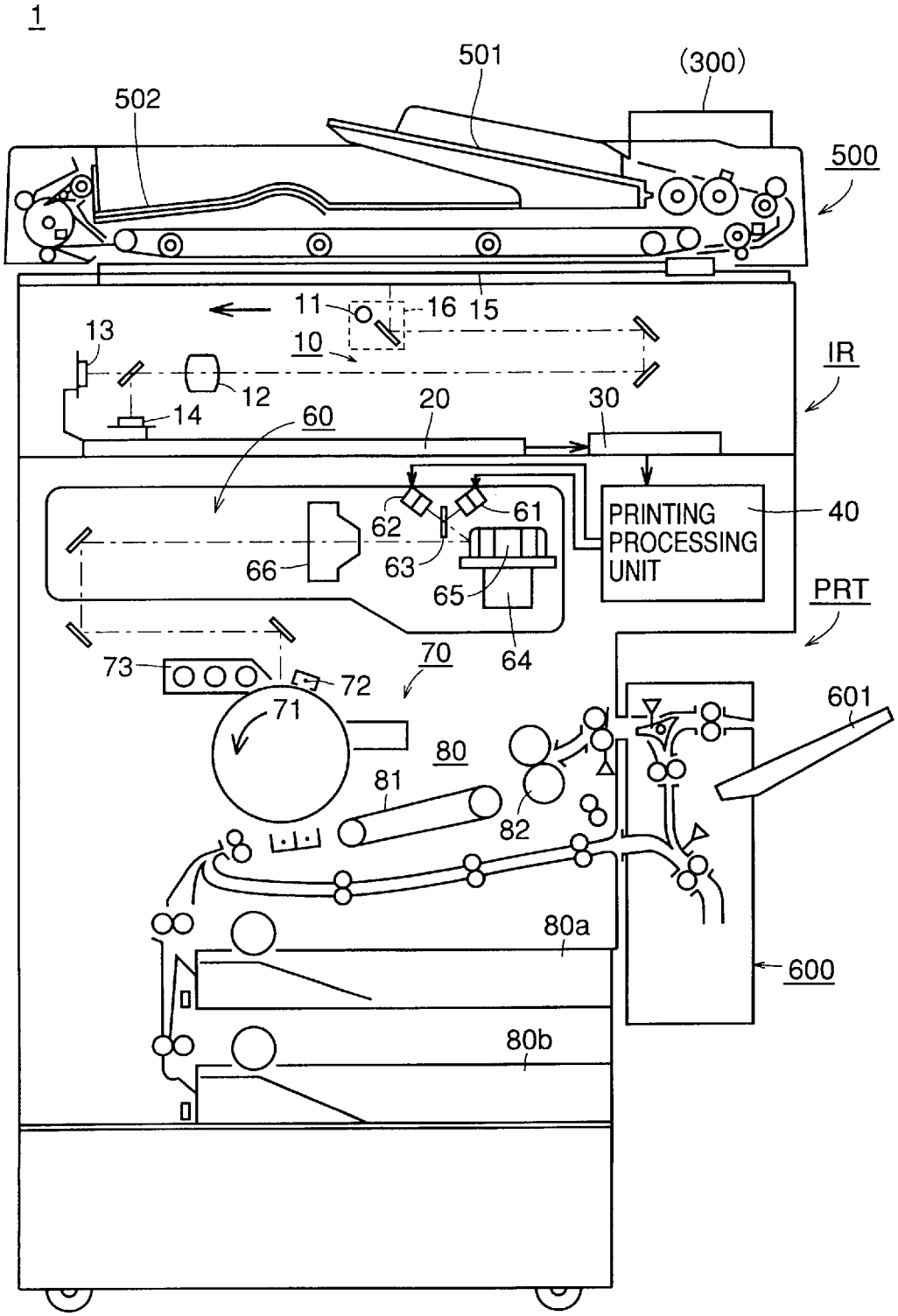
FIG. 1 is a cross sectional view schematically showing the structure of a copying machine having a multi-job function.

Referring to FIG. 1, copying machine 1 having a multi-job function mainly includes an image reader IR for reading an original image and producing image data, an image storing unit 30 for temporarily storing the image data obtained by image reader IR, a printer PRT for printing images on a copying sheet based on the image data stored in image storing unit 30, an operation panel 300 for inputting operations provided on the top of copying machine 1 (in the vertical direction with respect to the surface of the sheet), an original transport unit 500 for transporting an original and reversing the front and back of the original if necessary, and a paper re-feed unit 600 for reversing the front and back of the copying sheet transferred with the images if necessary for refeeding to printer PRT.

In original transport unit 500, an original set at an original feed tray 501 is automatically set at the reading position on an original glass 15 from its lowermost original sheet in response to a printing instruction, and discharged onto a discharge tray 502 once reading by reader IR completes.

Reader IR is formed of a scanning system 10 and an image signal processing unit 20. In scanning system 10, the image of an original sheet set at the reading position is exposed to light from an exposure lamp 11 attached to a scanner 16 which travels under the image. Light reflected from the original sheet passes through a reflection mirror and a condensing lens 12, and input to photoelectric conversion elements 13 and 14 formed of a CCD array or the like. Then, a signal obtained by scanning system 10 is sent to image signal processing unit 20. In image signal processing unit 20, the input signal is subjected to image processing such as binarization, picture-quality correction, magnification-changing, and image editing. The image data resulting from the image processing is stored in image storing unit 30.

Printer PRT is formed of a printing processing unit 40, an optical system 60, an image forming system 70, and a sheet transport system 80. Printing processing unit 40 drives optical system 60 based on image data from image storing unit 30. In optical system 60, semiconductor lasers 61 and 62 emit laser beams based on a signal controlled by printing processing unit 40. These beams are combined by a dichroic mirror 63, reflected by a polygon mirror 65 rotated by a motor 64, and directed to a photoreceptor 71 in image forming system 70 through a main lens 66.

In image forming system 70, photoreceptor 71 is charged by a corona charger 72, and then irradiated with the laser beam from optical system 60. Thus, a latent electrostatic image is formed on photoreceptor 71. Then, a developer 71 applies toner on the latent electrostatic image. The toner image on photoreceptor 71 is transferred onto a copying sheet fed from a feeding cassette 80*a* or 80*b*. Thereafter, the sheet is transported to a fixing device 82 by the function of a sheet transport belt 81, has its toner fixed onto the sheet by heat and pressure, and then discharged onto discharge tray 601 in paper re-feed unit 600.

Copying machine 1 can detect an error such as paper jam in original transport unit 500 and printer PRT during these operations. Copying machine 1 can detect an error such as paper-empty condition in a paper feeding cassette in printer PRT or an inappropriate setting of an original in the reading position in original transport unit 500. Furthermore, copying machine 1 can detect an interruption of the operation of copying machine 1 due to a trouble.

Figure 2:
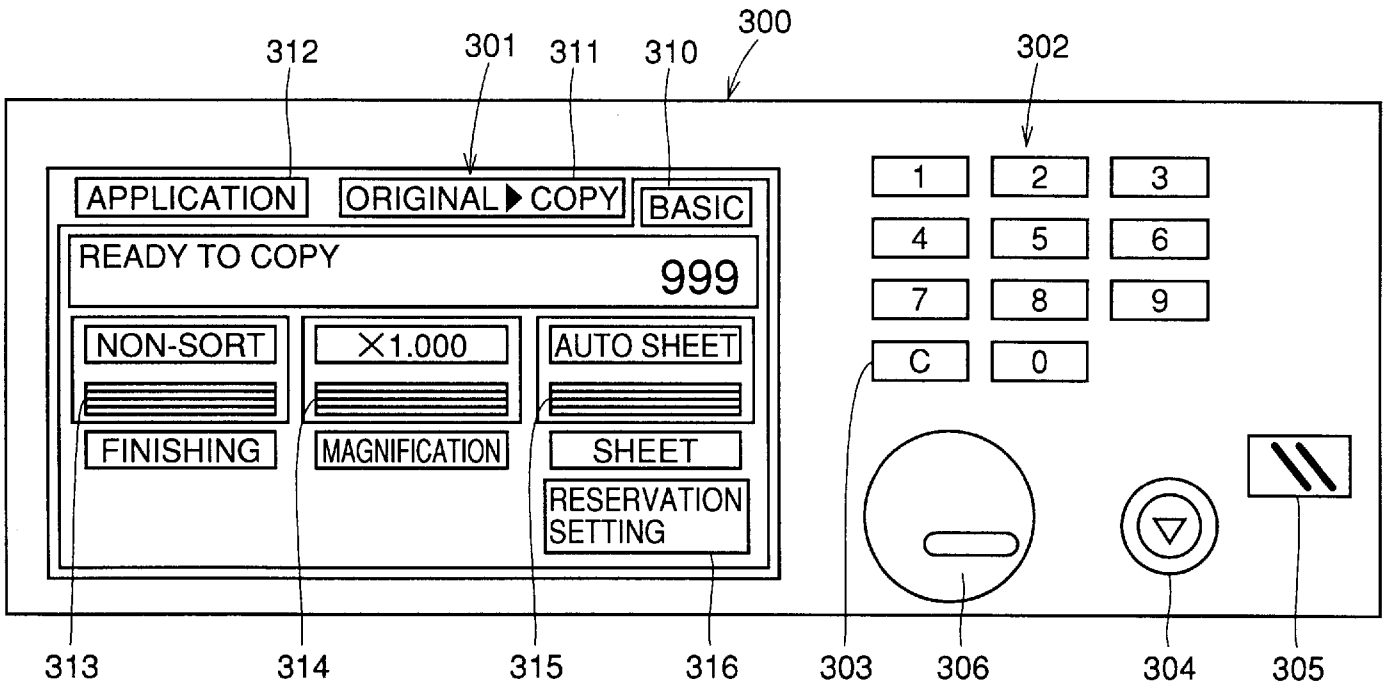
FIG. 2 is a plan view showing the structure of an operation panel.

FIG. 2 is a plan view showing the structure of operation panel 300.

A liquid crystal touch panel 301 in operation panel 300 displays a plurality of images depending upon the condition of copying machine 1. FIG. 2 shows a basic image displayed among the plurality of images. In the basic image, touch keys 310, 311 and 312 for three large items labeled "BASIC", "ORIGINAL→COPY", and "APPLICATIONS" are displayed. Herein, "BASIC", "ORIGINAL→COPY", and "APPLICATIONS" are items for classifying setting items for various copying conditions which can be executed by copying machine 1. For example, copying condition setting items such as copying sheet size, magnification and sorting mode belong to "BASIC". The basic image as shown is displayed when touch key 310 corresponding to classifying item "BASIC" is pressed. In the central part of the image displayed are touch keys 313, 314 and 315 for setting items belonging to classifying item "BASIC", i.e., copying sheet size, magnification and sorting mode, respectively. In the lower portion of the image, a reservation setting key 316 for setting a reservation job is displayed. Note that the basic image is displayed immediately after turning on the power supply or at the time of resetting the panel.

A ten key 302 is used for inputting numerical values such as the number of copies or a copying magnification, and a clear key 303 is used for clearing numerical values input by ten key 302. A start key 306 is used to start copying, and a stop key 304 is used to interrupt an ongoing copying operation. A panel reset key 305 is used to reset a copying condition set by an operation to a setting image displayed by liquid crystal panel 301 to the initial condition.

Figure 3:
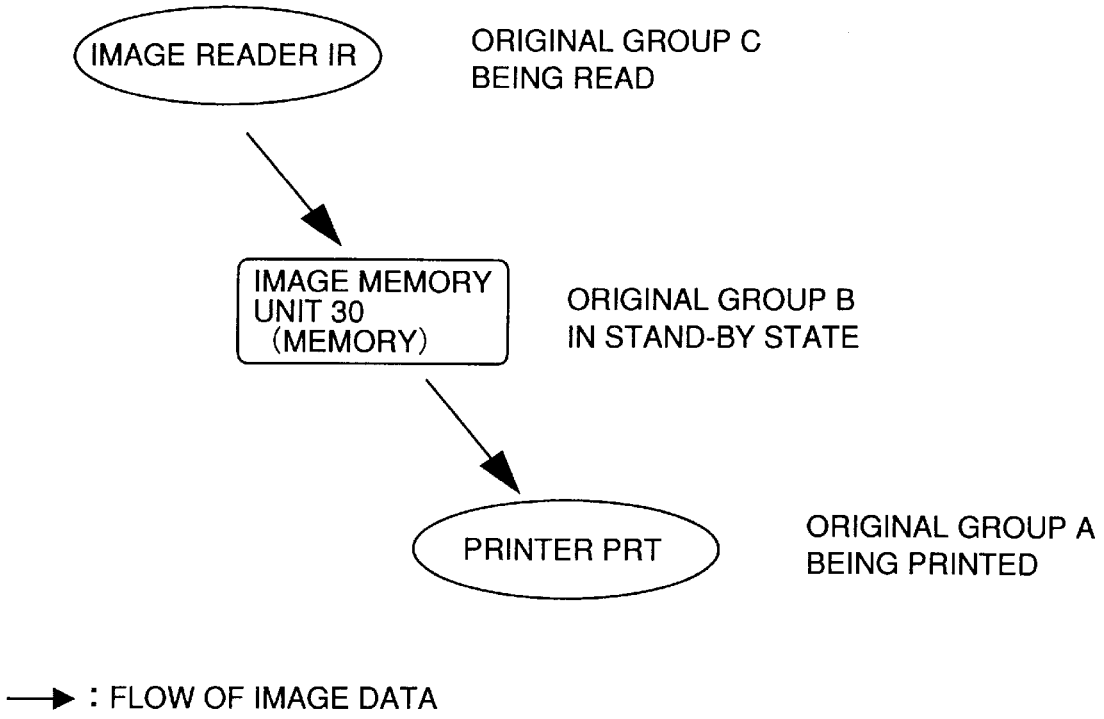
FIG. 3 is a diagram for use in illustration of the multi-job function of the copying machine.

FIG. 3 is a diagram for use in illustration of the multi-job function of copying machine 1.

Since an original is set until a copy is obtained, copying machine 1 mainly performs three processings, in other words the processings of reading original images and producing image data, correcting and storing the image data, and printing images based on the stored image data. The series of the three processings are executed to an original group in the above-described order, and a copy of original group is obtained. These three processings are performed at image reader IR, image storing unit 30 and printer PRT, respectively.

Herein, a series of processings conducted by the copying machine such as a mode setting, a reading operation and a printing operation to a group of originals are referred to as "job". The multi-job function of copying machine 1 refers to simultaneously performing a plurality of such jobs in parallel. For example, during executing printing output at printer PR in a job to an original group A, a reading operation can be executed by image reader IR in a job to another original group. More specifically, by the multi-job function, a printing operation and a reading operation can be simultaneously independently performed in parallel.

Since a printing operation and a reading operation proceed independently from each other, even if one of the printing and reading operations is interrupted by a trouble, the other operation will continue without being interrupted.

Figure 13:
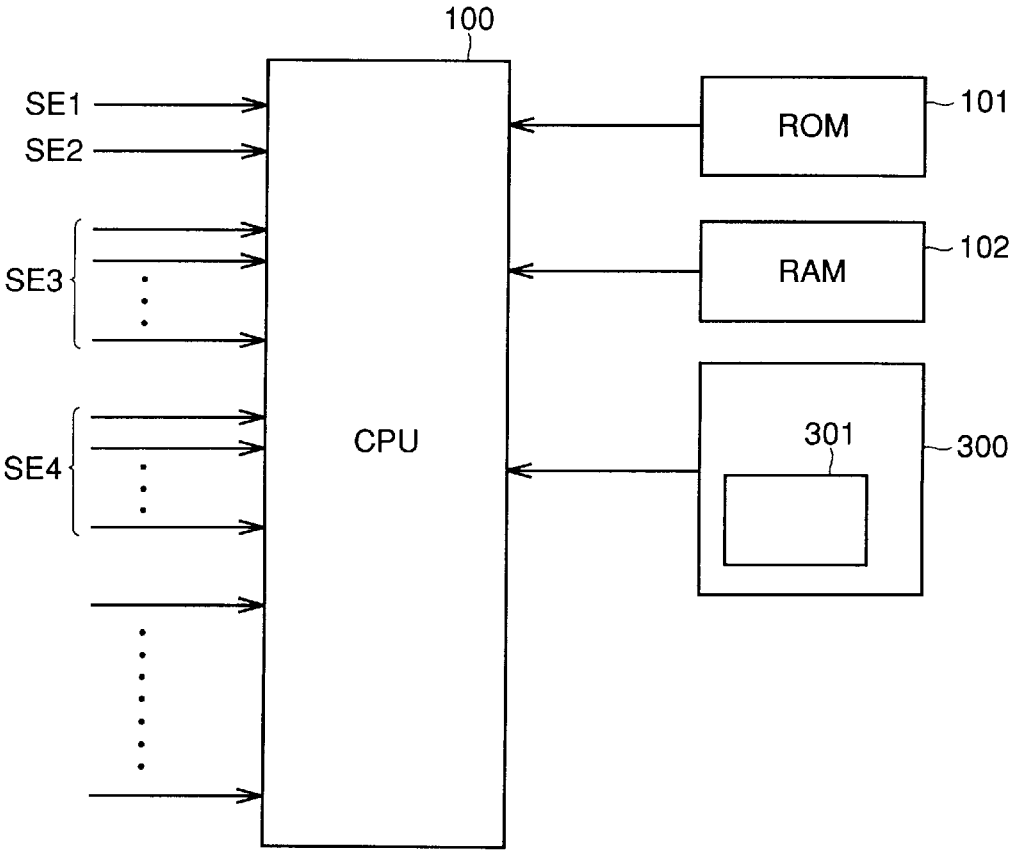
FIG. 13 is a block diagram showing a control circuit controlling the copying machine.

FIG. 13 is a block diagram showing a control circuit for controlling copying machine 1. The control circuit 1 includes an ROM 101 storing programs to operate copying machine 1, a microcomputer 100 (hereinafter "CPU 100") for executing the programs, and an RAM 102 for storing information necessary for executing the programs. CPU 100 is provided with signals from various keys on operation panel 300 and signals from paper empty sensors SE1 and SE2 for detecting paper feed cassettes 80*a* and 80*b* running out of paper sheets, a jam detection sensor group SE3 for detecting a jam of a copying sheet, a jam detecting sensor group SE4 detecting a jam of an original in the original transport unit, and other sensors for detecting abnormalities or states in various elements in the copying machine. In response to these input signals, CPU 100 sets various copying conditions or controls copying machine 1 by detecting the state of various elements in the copying machine. CPU 100 outputs a control signal to operation panel 300 to selectively display a plurality of images stored in RAM 102 on liquid crystal touch panel 301.

Figure 4:
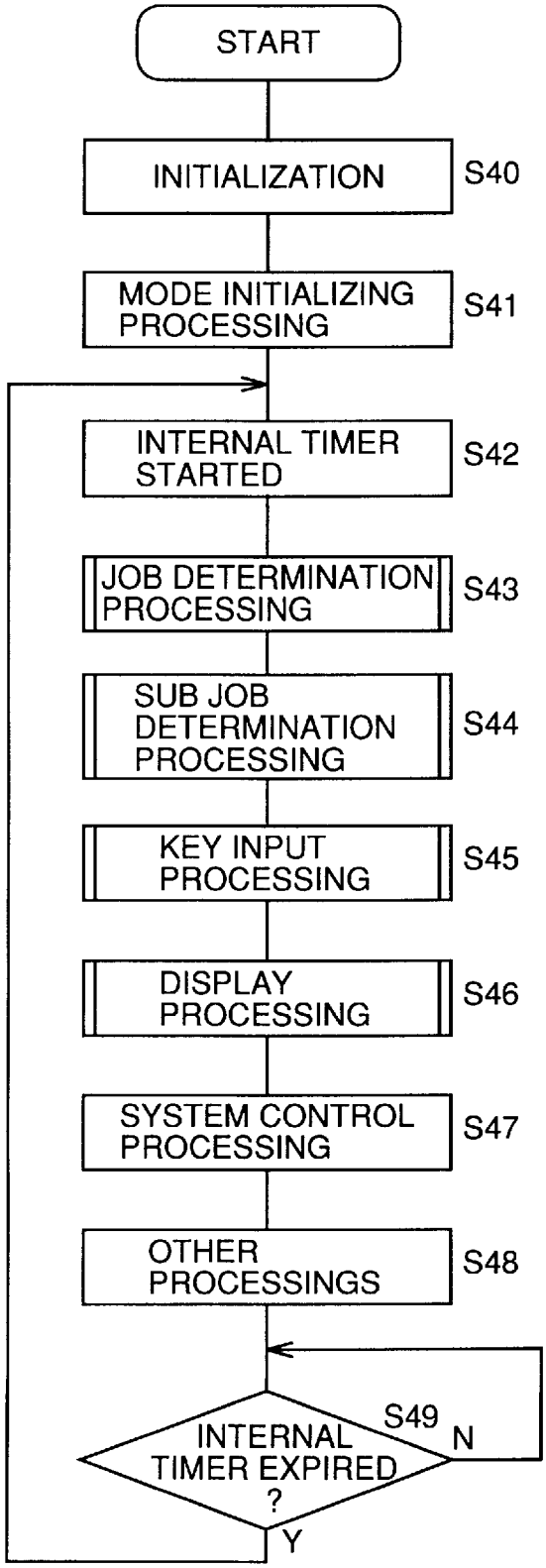
FIG. 4 is a flow chart for use in illustration of a main routine executed by a CPU which controls the operation of the copying machine.

FIG. 4 is a flow chart for use in illustration of a main routine executed by CPU 100 which controls the operation of copying machine 1.

When the power supply of copying machine 1 is turned on to reset CPU 100, a program is started. The RAM is cleared in step (hereinafter abbreviated as "S") 40, the CPU is initialized including setting of various registers, and initialization of various copying conditions in copying machine 1 is performed in S41.

Then, in S42, an internal timer built in CPU 100 having its value previously set in the initialization for defining the length of one routine is started.

Then, a job determination processing for determining the state of a current job is performed in S43 followed by a sub job determination processing in S44 for determining the state of a sub job, a key input control processing in S45 for controlling key input by hard keys and touch keys, and a display control processing in S46 for controlling display at the display unit. The processings from S43 to S46 are performed in subroutines, which will be described later.

After these processings, a system control processing for controlling the normal operation of copying machine 1 is performed in S47 followed by other processings in S48.

After the processings from S42 to S48, it is determined in S49 if the internal timer set in S42 has been expired. If the internal timer has been expired (YES in S49), that one routine is completed, and the processing returns to S42. If the internal timer has not been expired (NO in S49), the processing remains at S49.

Figure 5:
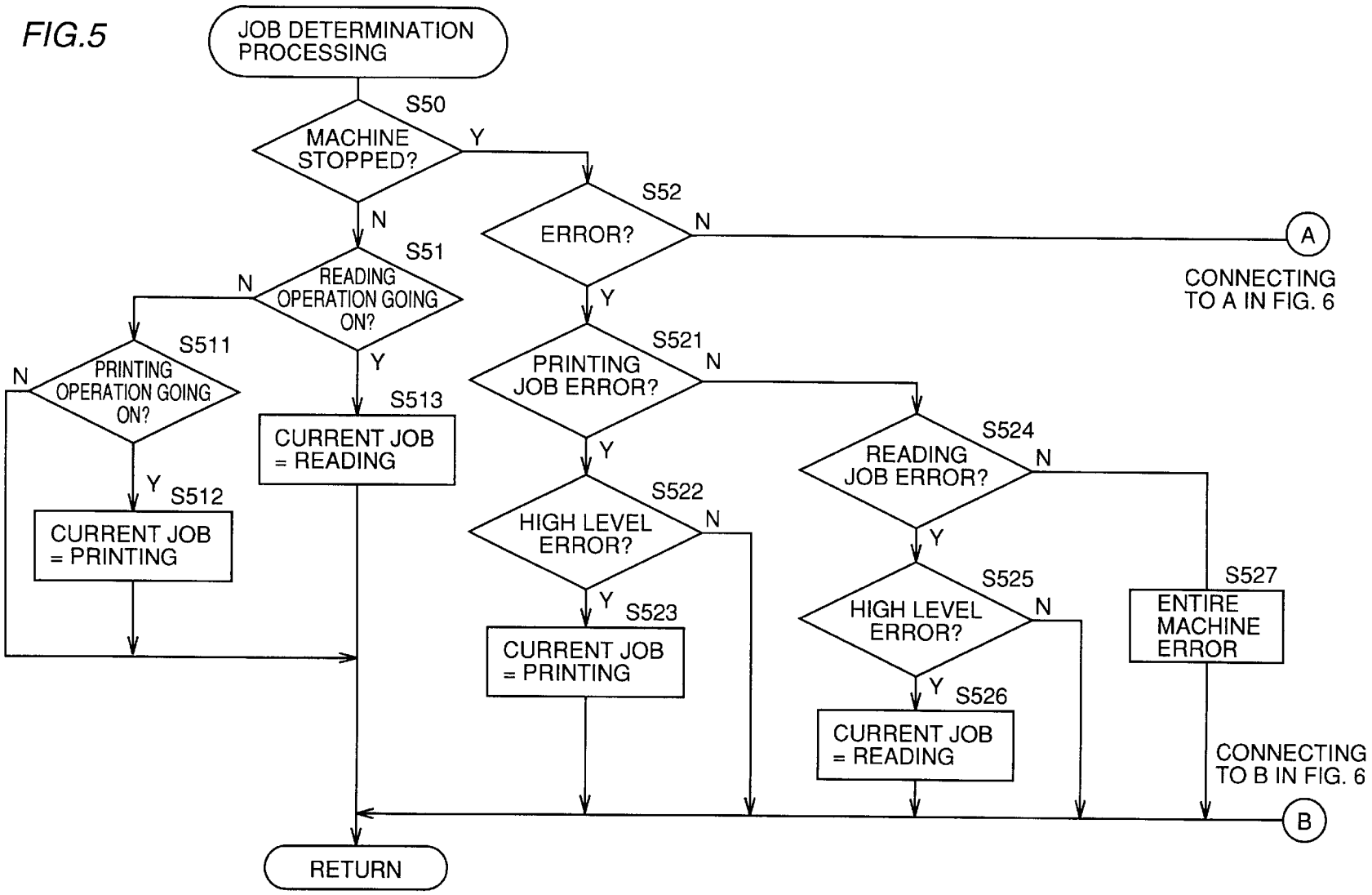
FIG. 5 is a first flow chart for use in illustration of a subroutine in a job determination processing in S43 in FIG. 4.
Figure 6:
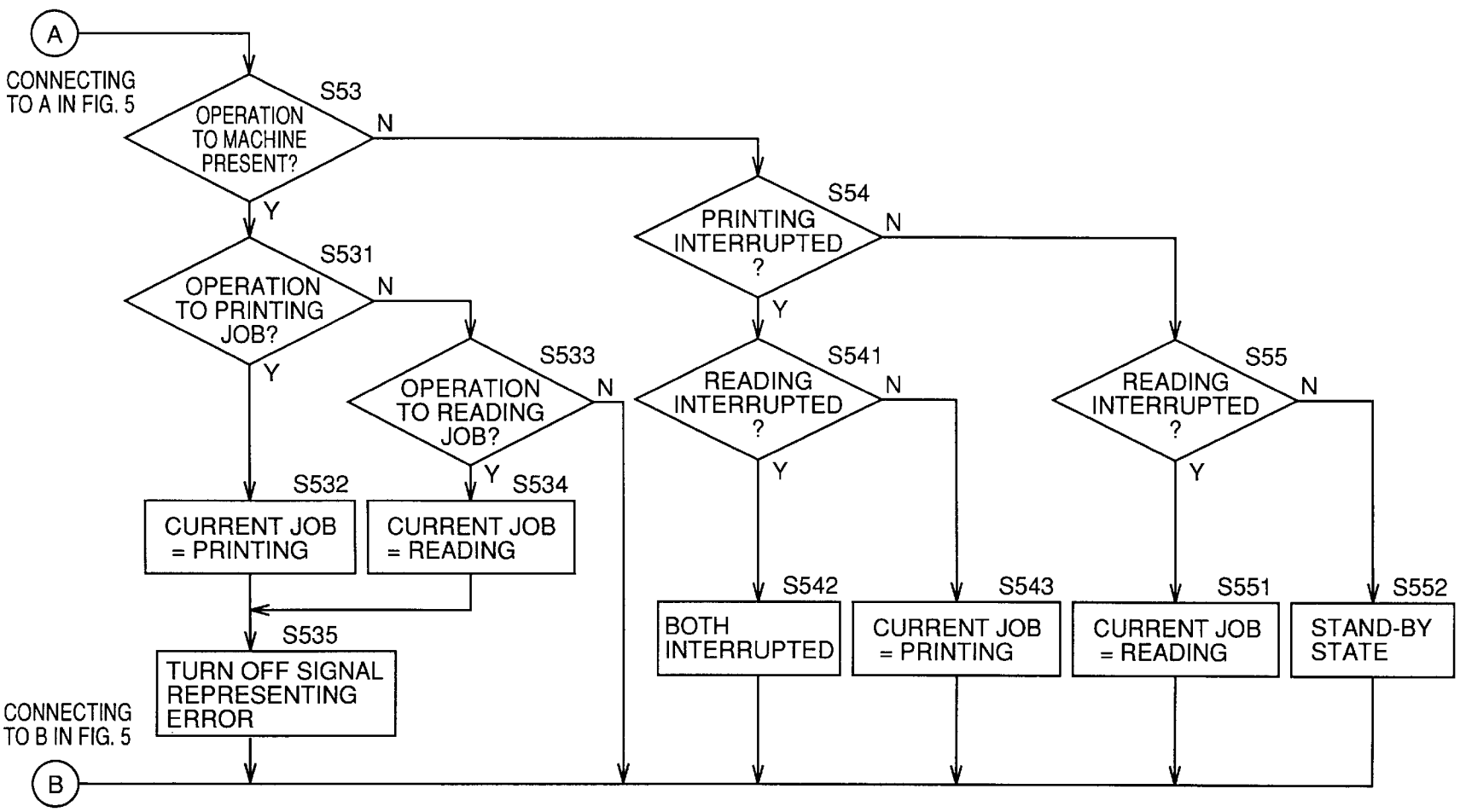
FIG. 6 is a second flow chart for use in illustration of the subroutine in the job determination processing in S43 in FIG. 4.

FIGS. 5 and 6 are flow charts for use in illustration of the subroutines in the job determination processing in S43 shown in FIG. 4.

Herein, "current job" refers to a job with high level importance within jobs being executed during the multi-job operation of copying machine 1. "Sub job" refers to job with low level importance. More specifically, when copying machine 1 executes a reading operation according to a job and a printing operation according to another job, the job executing an operation with higher level importance among these two operations is referred to as "current job". CPU 100 determines the state of each element in copying machine 1, and determines which operation among the these two operations has higher level importance depending upon the determined state. The job executing an operation with higher level importance is stored in RAM 102 as a current job, and the other as a sub job. If, for example, a reading operation has higher level importance in determination, the current job is stored as "reading operation" in the sense that it is a job executing a reading operation.

One element in determining the importance by CPU 100 is the kind of an error encountered during the operation of copying machine 1. For errors, various levels are set depending on the difficulty in recovering from the error. Those belonging to high error levels include a jam of a copying sheet, a jam of an original or the like, and those belonging to low error levels include a paper empty condition, a original setting fault or the like.

It is determined in S50 if copying machine 1 has been stopped. If it has not been stopped (NO in S50), it is determined in S51 if a reading operation is going on. If a reading operation is going on (YES in S51), after the current job is stored as "reading" in S513, the routine returns.

If a reading operation is not going on in copying machine 1 (NO in S51), it is determined in S511 if a printing operation is going on. If a printing operation is going on (YES in S511), the current job is stored as "printing" in S512, the routine returns. If a printing operation is not going on (NO in S511), the state of the current job before the routine was called is maintained, and the routine returns.

If copying machine 1 has been stopped (YES in S50), it is determined in S52 if it is a timing for an error (such as paper jam and paper empty as described above). Though not specifically described, in copying machine 1, a signal representing the presence of an error is turned on the moment an error occurs and is turned off the movement the machine is recovered from the error. If it is in the timing for such an error (YES in S52), the kind and level of the error is determined in S521 to S527.

It is determined in S521 if it is an error in a printing job. If it is an error during a printing operation (YES in S521), it is determined in S522 if the error level (in other words the level of priority for displaying the error) is high. If the error level is high (YES in S522), the current job is switched to "PRINTING OPERATION" in S523 and the routine returns, while if the error level is not high (NO in S522), the routine returns without switching the current job.

If it is not an error in a printing operation (NO in S521), it is determined in S524 if it is an error in a reading job. If it is an error in the reading job (YES in S524), it is determined in S525 if the error level is high. If the error level is high (YES in S525), the current job is switched to "READING OPERATION" in S526 and the routine returns, while if the error level is not high (NO in S525), the routine returns without switching the current job. If it is not an error in a reading operation (and not an error in a printing operation, NO in S524), the error of the entire machine is determined in S527, and the routine returns.

If there is no error (NO in S52), it is determined in S53 if an operation by the user to copying machine 1 (such as opening/closing of the cover of the copying machine to address a jam, canceling the error or the like) has been made.

If there has been an operation to copying machine (YES in S53), it is determined in S531 if an appropriate processing to an error in a printing operation has been made. If the processing to the error in the printing operation has been appropriate (YES in S531), the current job is switched to "PRINTING OPERATION" in S532, the signal representing the presence of the error as described above is turned off, and the routine returns. Meanwhile, if the processing to the error in the printing operation has not been appropriate (NO in S531), it is determined in S533 if an appropriate processing has been made to an error in a reading operation. If the processing to the error in the reading operation has been appropriate (YES in S533), the current job is switched to "READING OPERATION" in S534, and the signal representing the presence of the error is turned off in S535 as is with the error in the printing operation, and the routine returns. If the processing to the error in the reading operation has not been appropriate (NO in S533), the routine directly returns.

If there has been no operation to copying machine 1 (NO in S53), it is determined in S54, S541 and S55 what interruption state the machine is in. It is first determined in S54 if a printing operation has been interrupted.

If the printing operation has been interrupted (YES in S54), it is determined in S541 if a reading operation has been interrupted in copying machine 1. If a reading operation has been interrupted (and a printing operation has been interrupted, YES in S541), it is determined that both operations have been interrupted in S542, and the routine returns. If a reading operation has not been interrupted (NO in S541), the current job is switched to "PRINTING OPERATION", and then the routine returns.

If a printing operation has not been interrupted (NO in S54), it is determined in S55 if a reading operation has been interrupted. If a reading operation has been interrupted (YES in S55), the current job is switched to "READING OPERATION" in S551, and then the routine returns. If a reading operation has not been interrupted (NO in S55), it is determined in S52 that both jobs are in a stand-by state and the routine returns. The state of the operation for the current job is thus determined.

Figure 7:
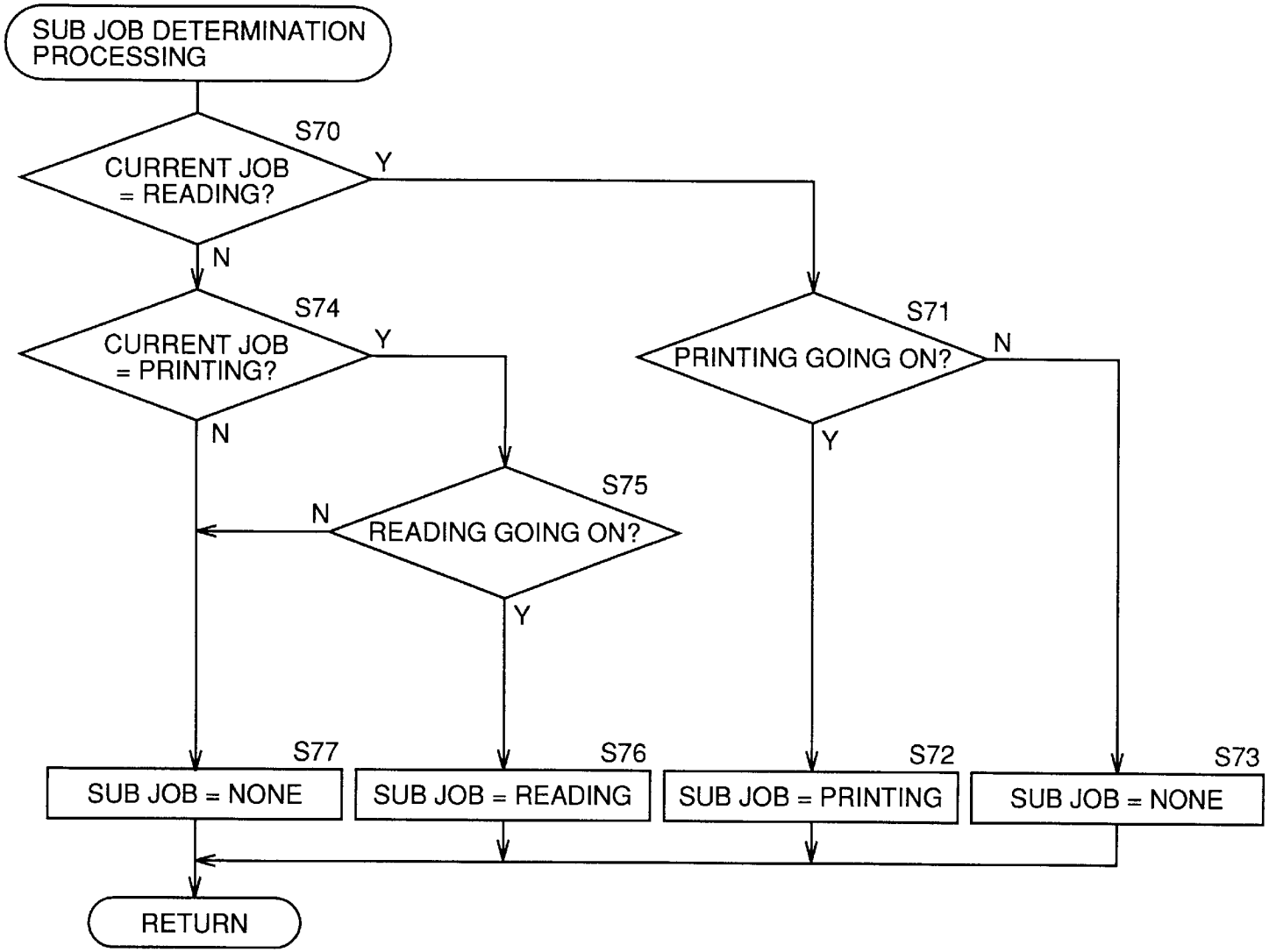
FIG. 7 is a flow chart for use in illustration of a subroutine in a sub job determination processing in S44 in FIG. 4.

FIG. 7 is a flow chart for use in illustration of the subroutine in the sub job determination processing in S44 shown in FIG. 4.

It is first determined in S70 if the current job is "READING OPERATION".

If the current job is "READING OPERATION" (YES in S70), it is determined in S71 if a printing operation is going on in copying machine 1. If a printing operation is going on (YES in S71), the sub job is labeled "PRINTING OPERATION" in S72, and the routine returns. If a printing operation is not going on (NO in S71), the sub job is labeled "NONE" in S73, and then the routine returns.

If the current job is not "READING OPERATION" (NO in S70), it is determined in S74 if the current job is "PRINTING OPERATION". If the current job is "PRINTING OPERATION" (YES in S74), it is determined in S75 if a reading operation is going on. If a reading operation is going on (YES in S75), the sub job is labeled "READING OPERATION" in S76, and then the routine returns. If a reading operation is not going on (NO in S75), the sub job is labeled "NONE" in S77, and the routine returns.

If the current job is not "PRINTING OPERATION" (and not "READING OPERATION", NO in S74), the sub job is labeled "NONE" in S77 (as is with the case of NO in S75), and the routine returns. The sub job is labeled "NONE" when the current job is neither "READING OPERATION" nor "PRINTING OPERATION", and when the entire error state of copying machine 1, the interruption or stand-by state of both "READING OPERATION" and "PRINTING OPERATION" is determined in the job determination processing in S43. The state of operation for the sub job is thus determined.

Figure 8:
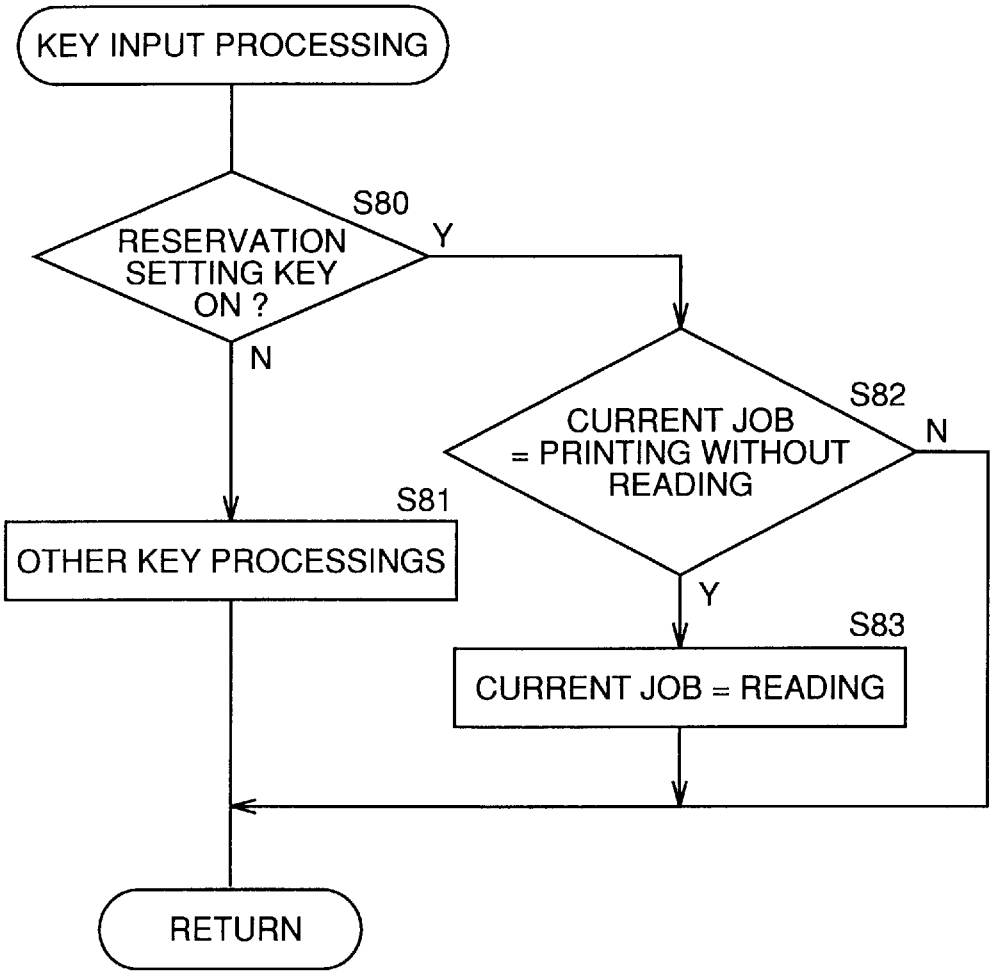
FIG. 8 is a flow chart for use in illustration of a subroutine in a key input processing in S45 in FIG. 4.

FIG. 8 is a flow chart for use in illustration of the subroutine in the key input processing in S45 shown in FIG. 4.

It is first determined in S80 if reservation setting key 316 has been pressed. If reservation setting key 316 has been pressed (YES in S80), it is determined in S82 if the current job is "PRINTING OPERATION" and the sub job is not "READING OPERATION" (in other words if only a printing operation is going on). If only a printing job is going on (YES in S82), the current job is switched to "READING OPERATION", and then the routine returns. Otherwise (NO in S82), the routine returns as is.

If reservation setting key 316 has not been pressed (NO in S80), an input processing from hard keys and touch keys other than reservation setting key 316 is performed, and the routine returns. The key input by the hard keys and touch keys is thus controlled.

Figure 9:
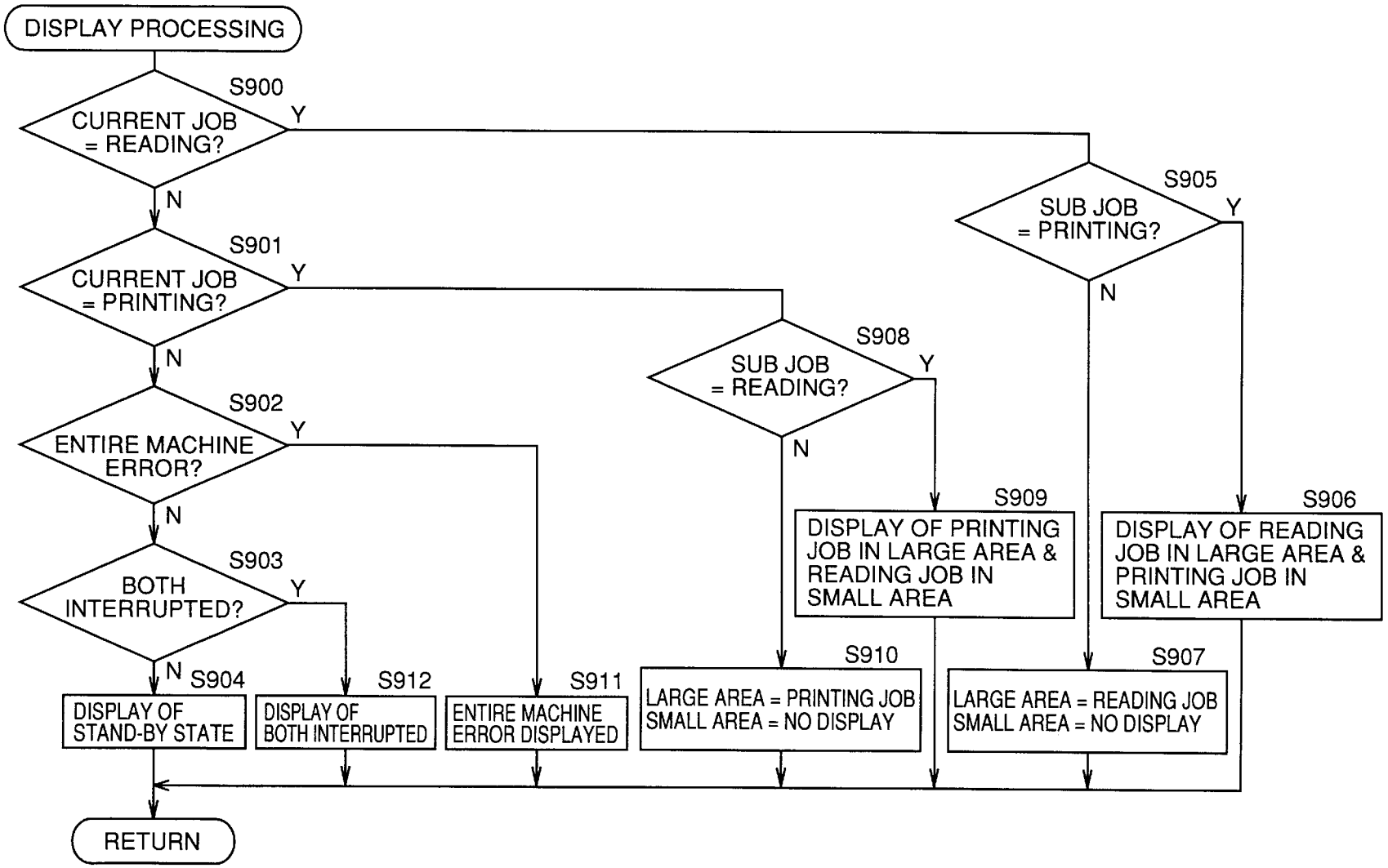
FIG. 9 is a flow chart for use in illustration of a subroutine in a display processing in S46 in FIG. 4.

FIG. 9 is a flow chart for use in illustration of the subroutine in the display processing in S46 shown in FIG. 4. The large area and small area as will be described correspond to a current job display portion 3011 and a sub job display portion 3012 in FIG. 10, respectively.

It is first determined in S900 if the current job is "READING OPERATION". If the current job is "READING OPERATION" (YES in S900), it is determined in S905 if the sub job is "PRINTING OPERATION". If the sub job is "PRINTING OPERATION" (YES in S905), a reading job is displayed in the large area and a printing job is displayed in the small area in S906, and the routine returns.

If the sub job is not "PRINTING OPERATION" (NO in S905), a reading job is displayed in the large area, the display in the small area is deleted (i.e., nothing is displayed in the small area) in S907, and the routine returns. Herein, if the current job is "READING OPERATION", and the sub job is not "PRINTING OPERATION", the sub job cannot be "READING OPERATION".

If the current job is not "READING OPERATION" (NO in S900), it is determined in S901 if the current job is "PRINTING OPERATION". If the current job is "PRINTING OPERATION" (YES in S901), it is determined in S908, if the sub job is "READING OPERATION". If the sub job is "READING OPERATION" (YES in S908), a printing job is displayed in the large area and a reading job is displayed in the small area, and the routine returns. If the sub job is not "READING OPERATION"(NO in S908), a printing job is displayed in the large area in S910, the display of the small area is deleted, and the routine returns.

If the current job is not "PRINTING OPERATION" (NO in S901), it is determined in S902 if it is the entire error state. If it is the entire error state (YES in S902), the entire error state is displayed in S911. If it is not the entire error state (NO in S902), it is determined in S903 if the two operations are both in an interrupted state. If both operations have been interrupted (YES in S903), the interruption of both "READING OPERATION" and "PRINTING OPERATION" are displayed in S912. If neither operation has been interrupted (NO in S903), the stand-by state is displayed in S904, and the routine returns. The display of the liquid crystal touch panel is thus controlled.

By the control shown in FIGS. 4 to 9 and as described above, images as shown in FIGS. 10 to 12 are normally displayed in liquid crystal touch panel 301 (see FIG. 2).

Figure 10:
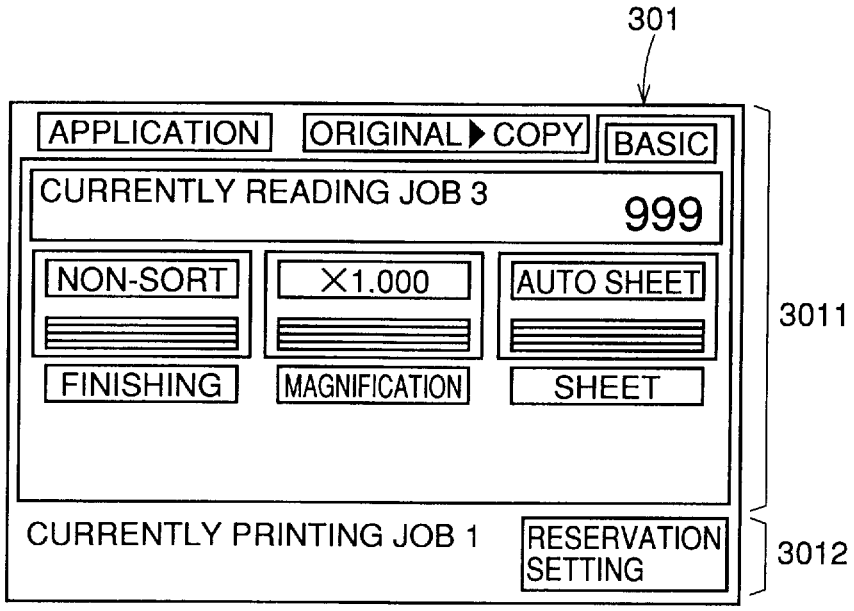
FIG. 10 is a diagram for use in illustration of display in a display portion.

FIG. 10 shows an image displayed on liquid crystal touch panel 301 during the multi-job operation of copying machine 1. In FIG. 10, the large display area labeled 3011 shows the state of the current job. In this example, the third job 3 is set as the current job. In display area 3011, it is displayed that in job 3, the current job, copying machine 1 is executing a reading operation, the number of copies set in job 3 is 999, and a non-sort mode, an equal magnification, and an auto sheet select mode are set for copying condition setting items, i.e., the copying sheet size, copying magnification and sort mode, respectively. Note that the jobs are attached with numbers in the order of registration for identifying these items.

Meanwhile, the small display area labeled 3012 shows the state of the sub job. The first job 1 is set as the sub job, and it is displayed that in job 1, a printing operation is going on. Other detailed setting conditions of job 1 are not displayed.

Figure 11A:
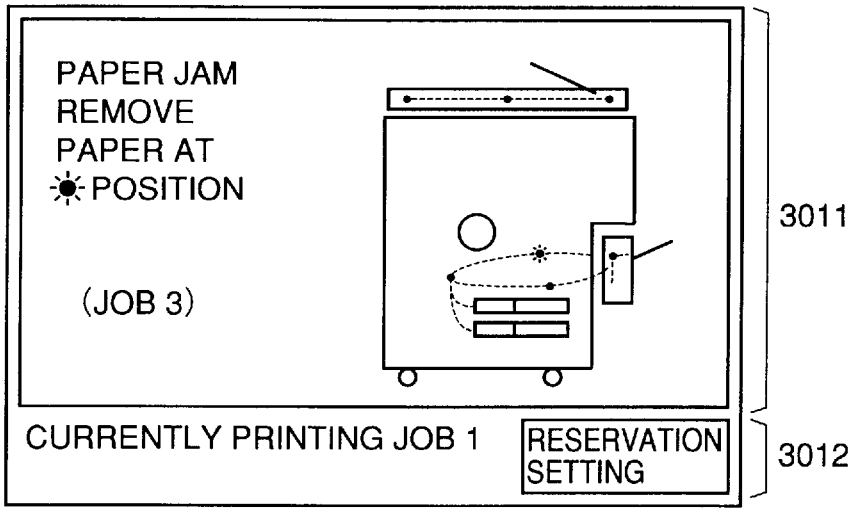
FIGS. 11A and 11B are diagrams for use in illustration of a display provided at the display unit when an error occurs in a sub job.

Let us now assume that a jam of a copying sheet occurs in the printing operation in job 1 set as the sub job. Once the copying sheet jam which is a high level error is detected, the current job is switched to the job executing the printing operation, in other words switched to job 1 by the processings in S52, S521, S522 and S523 shown in FIG. 5 and in the above described manner. Thus, as shown in FIG. 11A, the state of job 1 and the state of paper jam are displayed in display area 3011, and the state of job 3 set as the sub job is displayed in the display area.

Let us now assume that a copying sheet empty state (cassette running out of paper sheet) occurs in the printing operation in job 1 set as the sub job in the state shown in FIG. 10. If the copying sheet empty state which is a low level error is detected, the current job is not switched by the processings in S52, S521 and S522. Therefore, the state of job 1 as the sub job and the copying sheet empty state are displayed in display area 3012.

Note that if an error occurs in job 3 being processed as the current job, the current job is not switched. Regardless of the level of the error, the state of the error is displayed in display area 3011.

Based on the display as described above, an appropriate display is provided depending upon the levels of errors, and the user can be accurately informed of the state of the job.

In the above description, the error levels are divided into two levels, i.e., high and low levels and the size of the error display is adapted to these levels, but the error levels can be divided into three stages, high, medium and low to which the size of error display can correspond.

Figure 11B:
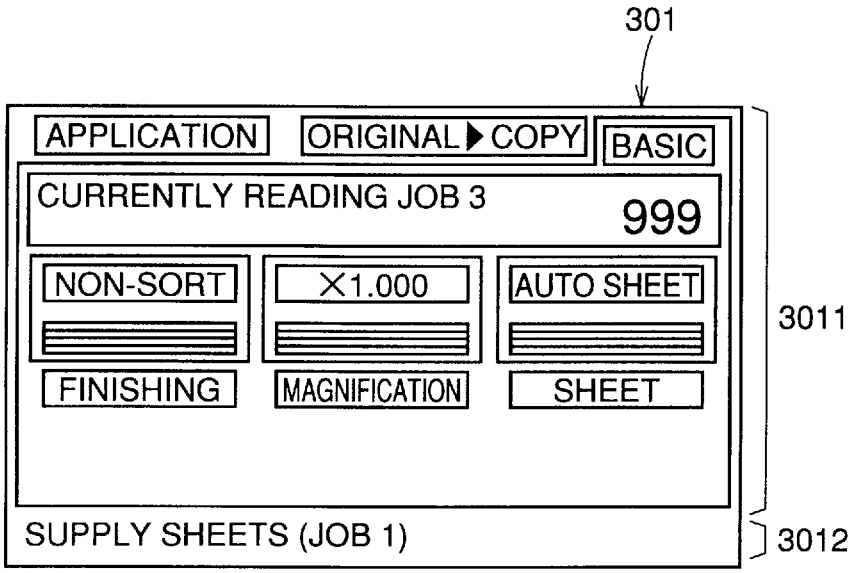
Figure 12:
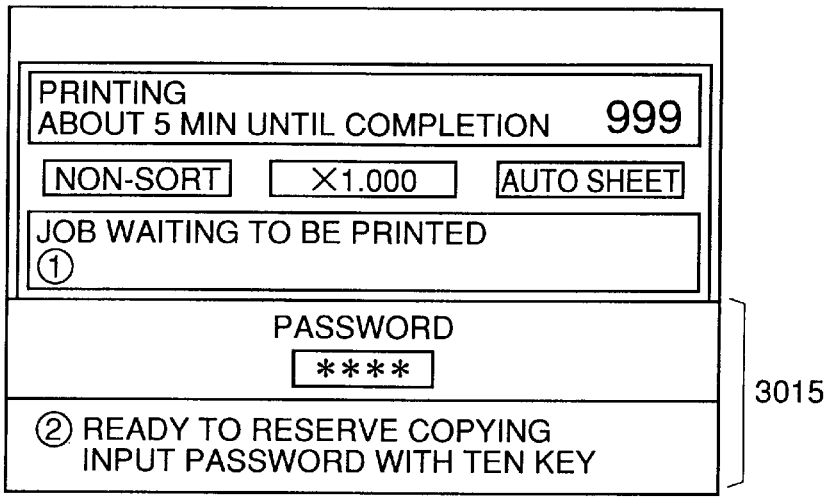
FIG. 12 is a view for use in illustration of the display of a medium level error in addition to the displays of a high level error and a low level error.

FIG. 12 is a view for use in illustration of a medium error display in addition to the high and low level error displays as described in conjunction with FIGS. 11A and 11B.

If a medium level error occurs in a job being processed as the sub job, an error display 3015 is provided on liquid crystal touch panel 301 as shown in FIGS. 11A and 11B. Error display 3015 has an area smaller than a high level error display 3013 and larger than a low level error display 3014. Herein, a password non-input error is a medium level error. Error display 3015 display the password non-input error, and asks the user to input the password.

By the above display, an appropriate display corresponding to three error levels can be provided in response to an error in the sub job, and the user can be accurately informed of the state of the sub job.

Although image reader IR is used as a device to input original images, a computer, facsimile or the like connected with external devices can be employed as an input device.

Furthermore, although the copying machine having the multi-job function is described as the embodiment, the present invention is applicable to a copying machine without such a multi-job function, and the state of display can be changed depending upon the level of an error occurring inside the machine.

Furthermore, although in this embodiment, the area of error display is changed to change the state of display, characters used to display an error may be made bold to change the state of display.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus capable of simultaneously executing a plurality of jobs to images in parallel, comprising:

a display for simultaneously displaying information related to the plurality of jobs executed in parallel, the display having a first display area and a second display area smaller than the first display area, displaying information related to a job in one of the display areas and information related to another job in the other display area; and a controller switching between information to be displayed in said first display area in the display and information to be displayed in said second display area, said controller determining the state of each job, displaying information related to a job having high level importance in said first area, and information related to a job having low level importance in said second display area.

2. The image forming apparatus as recited in claim 1, wherein said controller determines the importance of a job based on an error occurring during executing the job.

3. The image forming apparatus as recited in claim 2, wherein said controller determines which job has been executed when the error has occurred, displays information related to the determined job in said first display area and information related to another job in said second display area.

4. The image forming apparatus as recited in claim 2, wherein said controller determines the importance of operation based on the level of the error.

5. The image forming apparatus as recited in claim 1, wherein said job includes an operation of reading an image, and an operation of printing the read image.

6. The image forming apparatus as recited in claim 5, wherein said controller determines the importance of a job based on an error occurring during the reading operation and the printing operation.

7. The image forming apparatus as recited in claim 6, wherein said controller determines the importance of the job based on the level of the error.

8. The image forming apparatus as recited in claim 6, wherein said controller, when a prescribed error occurs in a reading operation, displays information related to a job executing the reading operation in said first display area.

9. The image forming apparatus as recited in claim 8, wherein said apparatus includes an original transport unit, and said prescribed error is a jam in said original transport unit.

10. The image processing apparatus as recited in claim 6, wherein said controller, when a prescribed error occurs in a printing operation, displays information related to a job executing a reading operation in said first display area.

11. The image processing apparatus as recited in claim 10, wherein said prescribed error is a jam of a printing sheet.

12. A processing apparatus for executing a prescribed operation, comprising:

a display for displaying information related to the state of an operation being executed;

a determination unit for determining the operation state and its importance; and a display controller for setting a display area on said display based on the result of determination by said determination unit and making said set display area display the determined operation state.

13. The processing apparatus as recited in claim 12, wherein said display controller changes the area of said display area to set depending upon the determination result.

14. The processing apparatus as recited in claim 13, wherein said determination controller determines the level of an error occurring during executing an operation.

15. An image forming apparatus, comprising:

a display for displaying a plurality of states related to an image forming operation;

a determination unit for determining the importance of a state to be displayed on said display; and a controller for changing the state of display on the display based on the importance determined by said determination unit.

16. A display method used in an image processing apparatus capable of simultaneously executing a plurality of jobs to images in parallel, said display method comprising steps of:

determining job operation state and its importance for each of said jobs are simultaneously executed by said image processing apparatus;

assigning display areas on a display device to said jobs in accordance with the determined importance; and displaying information related to the job operation state for each of said jobs on each of the assigned areas.

17. The display method as claimed in claim 16 further comprising a step of repeatedly executing said determining, assigning and displaying steps for changing the information displayed on the display area depending on changes of said job operation state.

18. The display method as claimed in claim 16, wherein said determining steps determines the importance in accordance with the level of as error occurring during job execution.

* * * * *